US006953214B2

(12) United States Patent
Paz

(10) Patent No.: US 6,953,214 B2
(45) Date of Patent: Oct. 11, 2005

(54) BOX CARRYING STRAP ASSEMBLY

(76) Inventor: Clarita Dela Paz, 256 Hill N. Dale Ct., Gurnee, IL (US) 60031

( * ) Notice: Subject to any disclaimer, the term of this patent is extended or adjusted under 35 U.S.C. 154(b) by 231 days.

(21) Appl. No.: 10/350,350

(22) Filed: Jan. 23, 2003

(65) Prior Publication Data

US 2004/0145202 A1 Jul. 29, 2004

(51) Int. Cl.[7] ..... A45F 5/00
(52) U.S. Cl. ..... 294/157; 294/152
(58) Field of Search ..... 294/157, 165, 294/74, 150, 152

(56) References Cited

U.S. PATENT DOCUMENTS 873,044 A * 12/1907 Hanson ..... 294/74
2,524,639 A * 10/1950 Saunders ..... 294/154
2,789,002 A * 4/1957 Nicholas ..... 294/33
3,923,222 A * 12/1975 Groves ..... 294/157
4,127,223 A * 11/1978 Uchin ..... 294/150
5,505,353 A * 4/1996 Marsh, Jr. ..... 224/148.6
5,641,189 A * 6/1997 Landman ..... 294/77
5,833,292 A * 11/1998 Lyons, Jr. ..... 294/152
6,427,886 B1 * 8/2002 Essex ..... 224/259

* cited by examiner

*Primary Examiner*—Kathy Matecki
*Assistant Examiner*—Esther O. Okezie
(74) *Attorney, Agent, or Firm*—Goldstein Law Offices, P.C.

(57) ABSTRACT

A carrying device, for carrying a box substantially in the shape of a rectangular prism, having a main strap, and a pair of transverse straps. The transverse straps extend parallel to each other, perpendicular to the main strap, cross the main strap, and are attached to the main strap at the crossings. A handle strap extends along the main strap, and is fastened to the main strap between the crossings, and between each of the crossings and the closest end of the main strap, forming handgrips at the crossings. The ends of the main strap and transverse straps have mateable buckles which allow the straps to be fastened around all sides of the box, and permit easy release.

3 Claims, 4 Drawing Sheets

BOX CARRYING STRAP ASSEMBLY

BACKGROUND OF THE INVENTION

The invention relates to a box carrying strap assembly. More particularly, the invention relates to a strap assembly which selectively secures onto a large box and provides handles to facilitate the carrying of said box.

A large box can be awkward for a single person to carry. In particular, when it is difficult to wrap one's arms around a box, the box can easily slip away. Also, even when a large box can be firmly held, it can throw the carrier 'off-balance'. Further, carrying a box in an awkward position can quickly lead to fatigue and can lead to back problems, and other medical ailment.

Despite these difficulties, it is often necessary for a single person to carry a large box. In addition, it is often necessary for a single person to carry a large box a great distance. In particular, people emigrating from certain parts of the world are known to place all of their worldly belongings in a large box. This box is often heavy—yet must be carried considerable distances.

In addition, a common practice among such persons is to tie the box with rope. However, at every border crossing, the ropes must be cut so that the box can be inspected. In addition, ropes have a tendency to dig into the box and can thereby compromise the strength and integrity of the box.

Over the years, people have proposed various devices that seek to help a person carry a box, luggage, and the like.

U.S. Pat. No. 4,127,223 to Uchin discloses a simple carrying device, which employs a pair of straps that extend around the side and bottom of an item, and have a shoulder strap for supporting the item. Uchin appears to be intended for carrying an attache case, and the like.

U.S. Pat. No. 5,641,189 to Landman discloses a device having multiple horizontal straps and multiple vertical straps, yet like Uchin, does not extend across the 'top' of the item. Landman is apparently designed for carrying 'ordnance components' such as "warheads, projectiles, etc."

U.S. Pat. No. 5,505,353 to Marsh, Jr., appears to disclose a strap suspension having an adjustable receptacle for containers. In particular, Marsh is another 'open top' harness, which appears intended for carrying beverage containers.

U.S. Pat. No. 5,863,056 to Hostetter discloses a mattress moving system which attaches around the bottom and side of a mattress, and provides castered platforms to facilitate transporting a mattress by a single person.

U.S. Pat. No. 618,333 to Colteryahn discloses a harness which is intended to wrap around a heavy item of furniture, such as a piano. Colteryahn does not provide handles, as it is intended for use when hoisting a large object in or out of a multistory building.

U.S. Pat. No. 1,120,020 to Bullock and U.S. Pat. No. 3,172,586 to Lu disclose handles which each have a plate-like member having multiple slots for accommodating a network of straps which wrap around a parcel, and a stack of books, respectively.

U.S. Pat. No. 925,986 to Blackburn, discloses a device for securing a bundle, which employs two pairs of parallel straps, each pair of parallel straps extending perpendicular to the other. A pair of handle straps are fastened at the crossings of the pairs of straps—placing the stress of the handles directly at the crossings, and making the box very unstable if a person carrying the box were to suddenly release one of the handles.

While these units may be suitable for the particular purpose employed, or for general use, they would not be as suitable for the purposes of the present invention as disclosed hereafter.

SUMMARY OF THE INVENTION

It is an object of the invention to produce a box carrying device which attaches upon an otherwise unwieldy box and allows the box to be conveniently and easily carried. Accordingly, the box carrying device includes pairs of straps which secure around all sides of the box, and which includes a pair of handles for facilitating easy handling of the box.

It is another object of the invention to produce a box carrying device which just as easily removes from a box as it is attached to the box. Accordingly, the main strap and transverse straps are joined by mateable, quick-release buckles which quickly fasten together, remain together indefinitely, but quickly release when desired. Thus, the device quickly allows the box to be opened for inspection, and then refastens onto the box following such inspection.

It is yet another object of the invention to provide a box carrying device which adjusts to various sized boxes. Accordingly, the straps each have an adjustment buckle for appropriately adjusting the length of each strap as it is being secured onto the box.

It is a further object of the invention to distribute the weight of the box and force on the straps in a way which promotes durability and reliability of the carrying device. Accordingly, the straps are broad heavy textile straps which are sewn together at the crossings. The handles, however, are attached to the main strap between the crossings.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
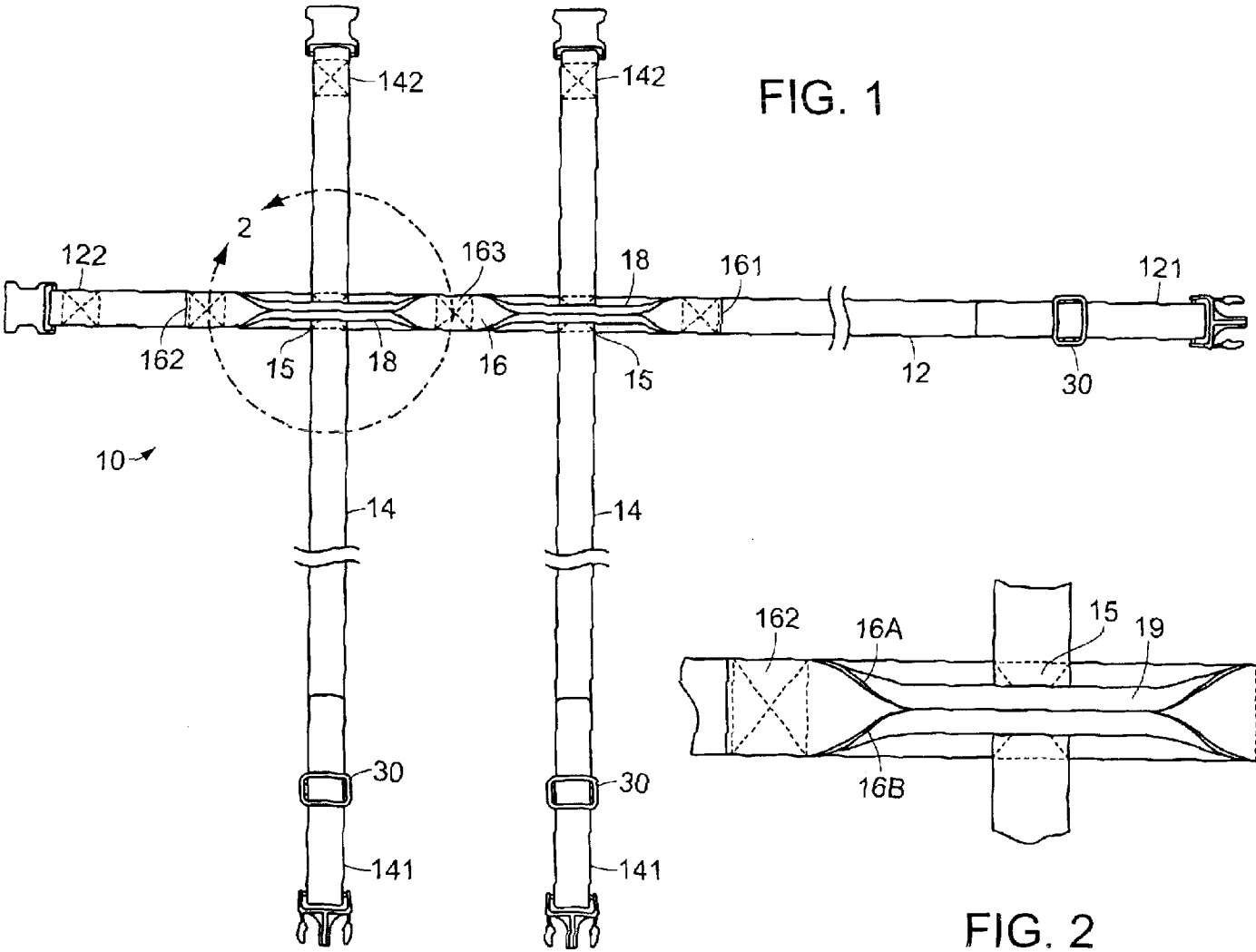
FIG. 1 is a top plan view, illustrating the carrying device laid flat, with a main strap, and a pair of transverse straps which extend parallel to each other, perpendicular to the main strap, and cross the main strap at crossings—where the transverse straps are attached to the main strap.

FIG. 1 illustrates a carrying device 10, having a main strap 12 having first and second ends 121, 122; and having a pair of transverse straps 14, each having first and second ends 141, 142. The transverse straps 14 extend parallel to each other, perpendicular to the main strap 12, and cross the main strap at a pair of crossings 15. A handle strap 16 includes a pair of handles 18 joined end-to-end. Each handle 18 is coextensive with the main strap 12, is centered across one of the crossings 15 but is not attached to the main strap 12 at said crossing 15. However, opposite ends of the handle 18 are attached on opposite sides of the crossing it is centered over.

Preferably, the handle strap 16 includes both handles 18, has a first end 161, a second end 162, and a midpoint 163. The handle strap 16 is fastened to the main strap 12 midway between the crossings 15 and at the midpoint 163 of the handle strap 163. The first end 161 of the handle strap 16 is fastened to the main strap 12 between the first end 121 of the main strap 12 and the closest crossing 15 thereto. The second end 162 of the handle strap 16 is fastened to the main strap 12 between the second end 122 of the main strap 12 and the closest crossing 15 thereto.

Mateable buckles are provided on each of the transverse straps 14, and on the main strap 12. The mateable buckles each include a male mateable buckle 20A and a female mateable buckle 20B. The male mateable buckles 20A are provided on each of the first ends 121, 141 of the main strap 12 and each of the transverse straps 14. The female mateable buckles 20B are provided on each of the second ends 122, 142 of the main strap 12 and each of the transverse straps 14.

Adjustment buckles 30 are provided on the main strap 12, and on each of the transverse straps 14. The adjustment buckles 30 facilitate adjustment of the length of the straps 12, 14, so as to allow the device 10 to be used on various size boxes.

As illustrated in the drawing figures, each of the straps is a broad and strong nylon textile, of heavy gauge, similar to that used for backpack straps and the like. Preferably, polypropylene webbing is used for the main strap 12, transverse straps 14, and handle strap 16. In this regard, the transverse straps 14 extend flat against the main strap 12 at the crossings 15 and are sewn thereat with a 'boxed x' stitch. Further, the handle strap 16 extends substantially coextensive with the main strap 12, and is in effect "laminated" to the main strap 12 at points where the handle strap 16 is fastened (sewn) to the main strap 12— the first end 161, second end 162, and midpoint 163.

Figure 2:
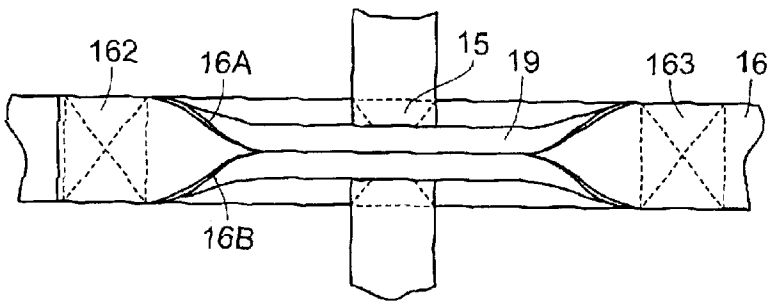
FIG. 2 is an enlarged top plan view, illustrating the handle strap secured to the main strap but 'bridging over' the crossing without being attached thereat.
Figure 5:
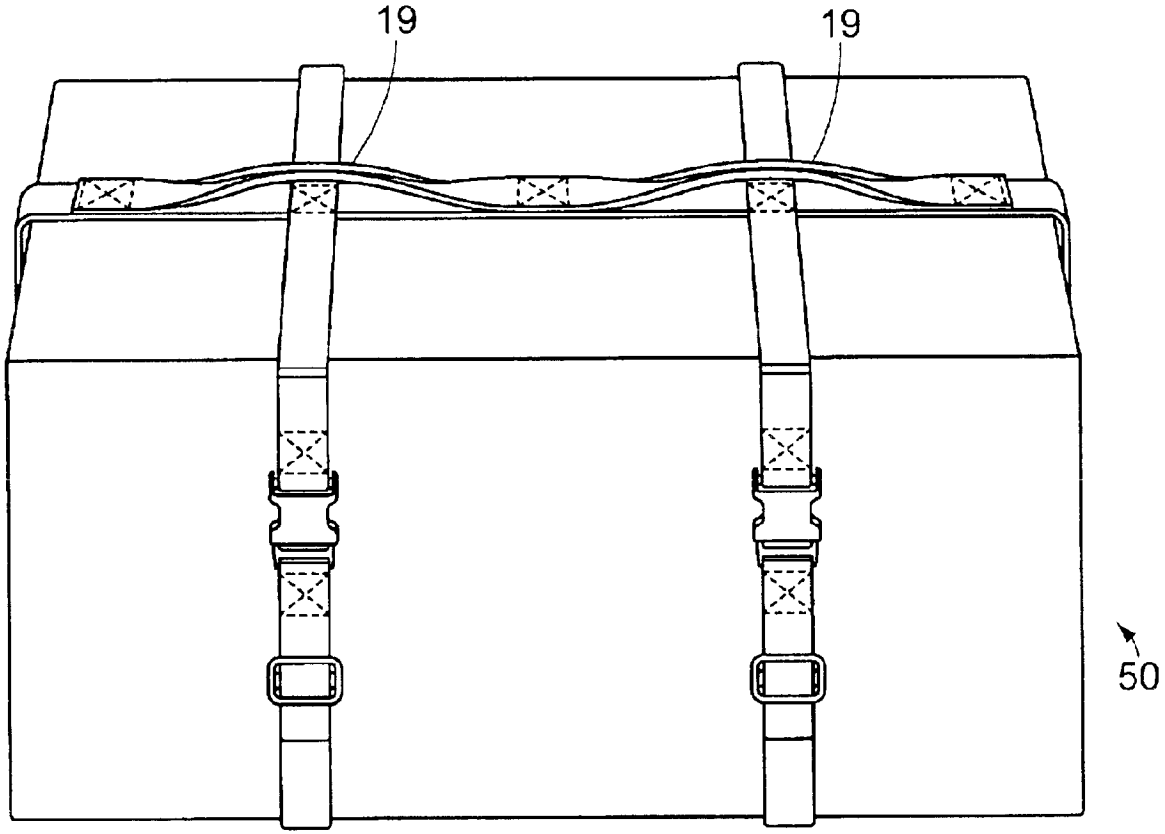
FIG. 5 is a diagrammatic perspective view, illustrating the carrying device fully fastened onto the box, wherein the adjustment buckles have been used to set the transverse straps to an appropriate length for securely holding the box.

Referring to FIG. 2, the handle strap 16 has a first side edge 16A and a second side edge 16B which extend away from each other when the handle strap 16 is laid flat, such as where sewn to the main strap at the handle strap second end 162 and handle strap midpoint 163. However, the first side edge 16A and second side edge 16B are gathered together, face each other, and are fastened together to form handgrips 19 over each crossing 15. As shown in FIG. 5, the unique positioning and configuration of the handgrips 19 provide convenient locations for grasping, and thus for carrying a box 50. The positioning of the handgrips 19, and the points of attachment of the fastening strap 16 to the main strap 12 more effectively distribute the weight of the box to the two handles, thus making the box more balanced, more stable, and less likely to tip—even if the user suddenly releases of one of the handgrips 19.

Figure 3:
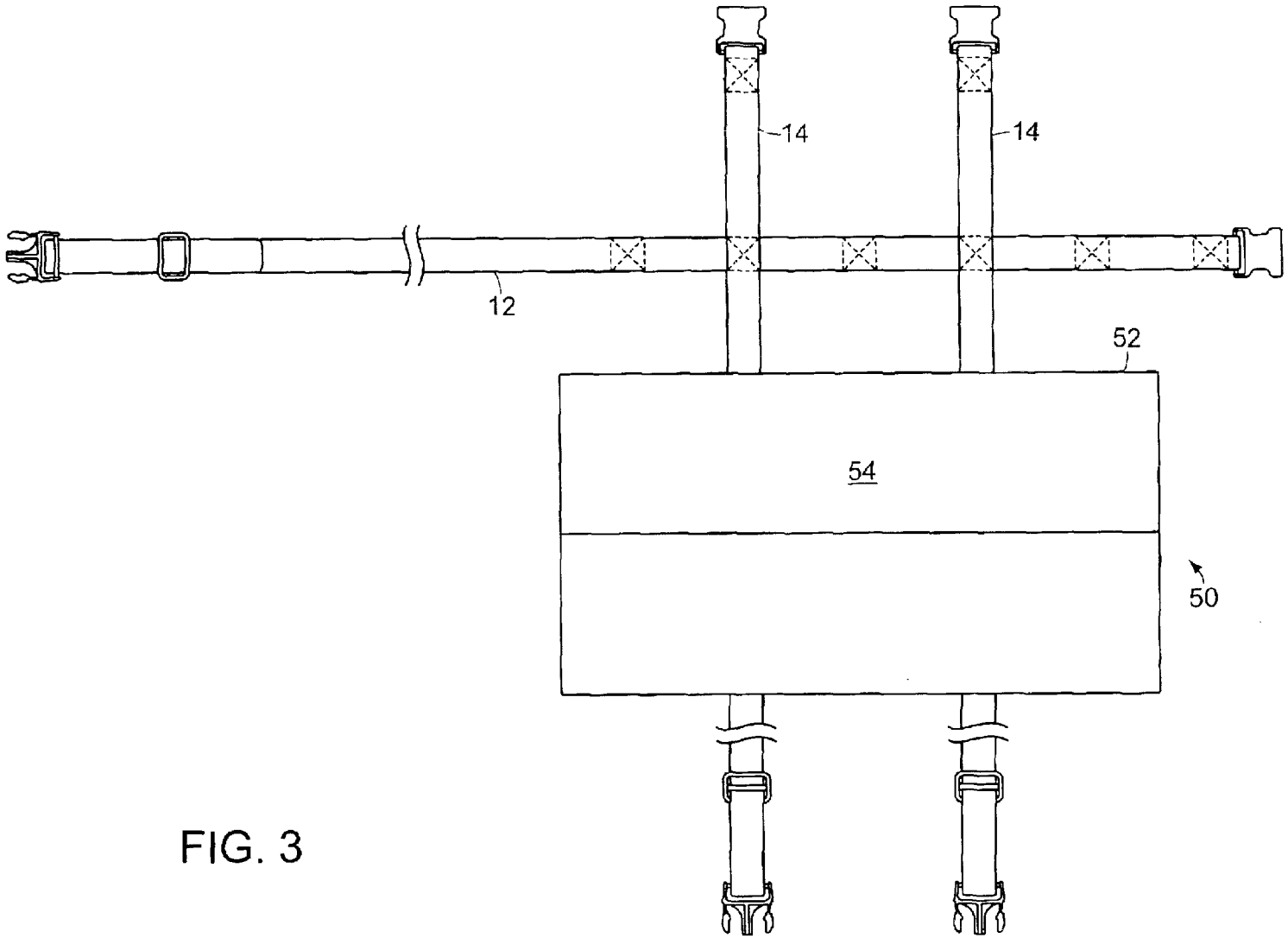
FIG. 3 is a bottom plan view, illustrating the carrying device laid flat, showing an initial step in fastening the device onto the box, wherein the box is positioned across the transverse straps.
Figure 4:
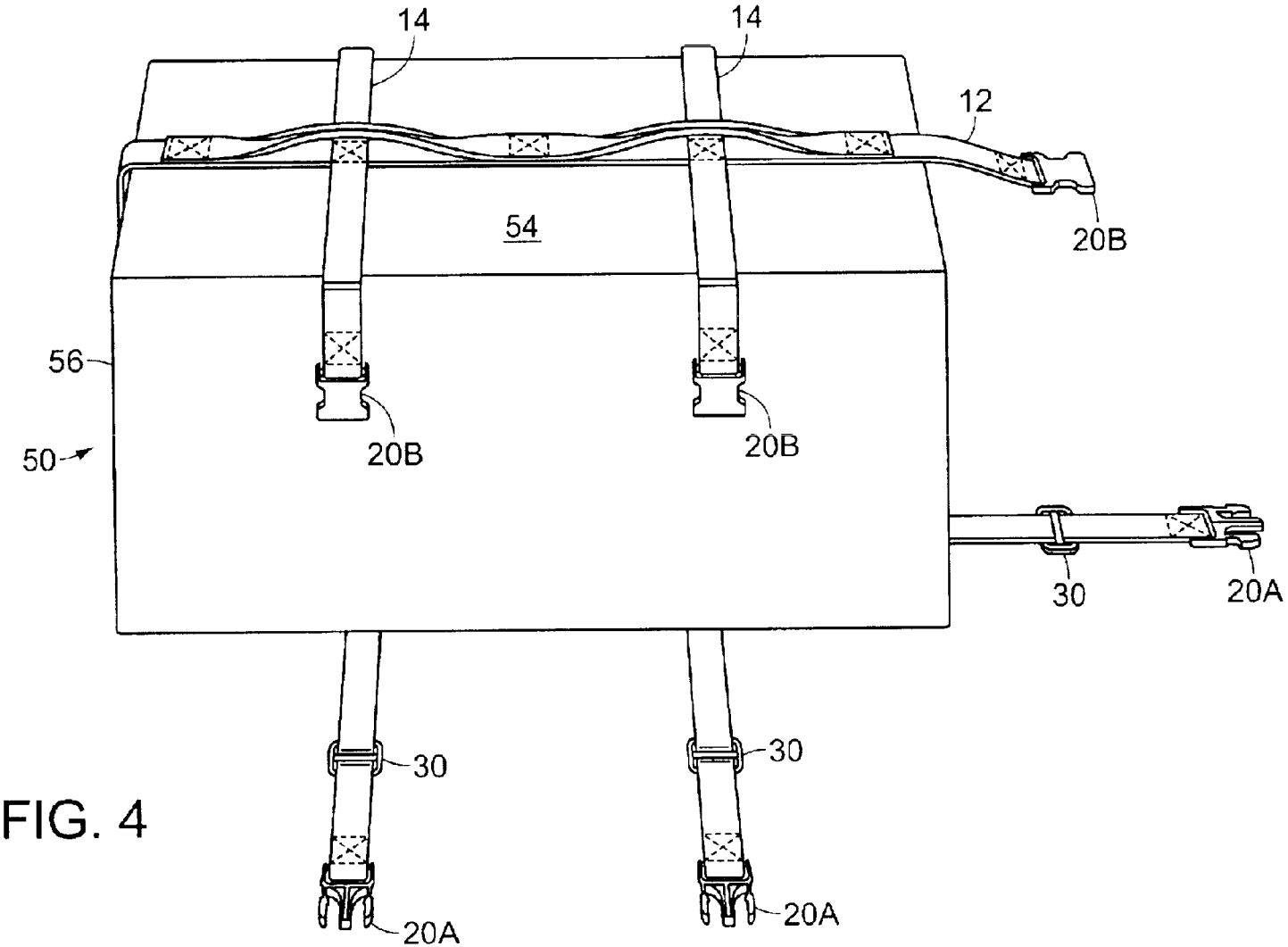
FIG. 4 is a diagrammatic perspective view, illustrating the main strap extending across the top of the box, wherein the mateable buckles need only be fastened to secure the box with the carrying device.

FIG. 3 and FIG. 4 illustrate one way in which the carrying device may be fastened onto the box 50. In particular, the box 50 is laid atop the transverse straps 14, with a long side 52 of the box parallel to the main strap 12. The transverse straps 14 are then folded over the box, carrying the main strap 12 onto a top surface 54 of the box 50. The main strap is then extended down one short side 56 of the box 50, and tucked underneath the box 50, so that the mateable buckles 20A and 20B on opposite ends of the main strap 12 and transverse strap 14 are brought into proximity, as seen in FIG. 4. The user can fasten the mateable buckles 20A and 20B on each of the straps 12, 14, and adjust the adjustment buckles 30 as appropriate to ensure a secure fit.

Referring now to FIG. 5, once secured on the box 50, the carrying device 10 can be used to easily carry the box 50, set it down on the ground when necessary, quickly release from the box 50 by simply releasing the mateable fasteners to allow for inspection of the box, and then reattach onto the box to once again ease its transport. The invention is illustrated by example in the drawing figures in throughout the foregoing description. Numerous variations, however, are possible while adhering to the inventive concept. Such variations are contemplated as being a part of the present invention.

What is claimed is:

1. A carrying device, for use with a box substantially in the shape of a rectangular prism, comprising:

a main strap, the main strap having a first end and second end, and a pair of mateable fasteners on the first end and second end for selectively mating the first end and second end after extending the main strap around the box;

a pair of transverse straps, the transverse straps extending parallel to each other and extending perpendicular to the main strap, the transverse straps each cross the main strap at a crossing and are sewn to the main strap at said crossing, each transverse strap having a first end and a second end, and a pair of mateable fasteners on the first end and second end for selectively mating the first end and second end after extending said transverse strap around the box; and a handle strap having a pair of handles, the handle strap is a continuous piece of textile material which includes both handles attached end-to-end, such that the handles are joined at a midpoint, opposite the midpoint on one of the handles is a first end of the handle strap, opposite the midpoint on the other of the handles is a second end of the handle strap each handle extending parallel to the main strap, each handle centered over one of the crossings but not attached at the crossing, wherein the handle strap is sewn to the main strap between the crossings at the midpoint, and the first and second ends of the handle strap are sewn to the main strap between the first and second ends of the main strap and its nearest crossing, respectively.

2. The carrying device as recited in claim 1, wherein the handle strap has a first side edge and a second side edge, wherein the handle strap is laminated flat against the main strap where sewn to the main strap with the first and second edge extending parallel and fully away from each other, and wherein the first side edge and second side edge are gathered toward each other and are attached together over the crossings to form handgrips thereat.

3. The carrying device as recited in claim 2, wherein the main strap, transverse strap, and handle strap are constructed of polypropylene webbing.

* * * * *